United States Patent [19]

Foy

[11] Patent Number: 4,696,249

[45] Date of Patent: Sep. 29, 1987

[54] APPARATUS FOR ATTACHING SAIL-BOARD BOOM TO MAST

[76] Inventor: Michael W. Foy, 125 Lake Ave. W. #3, Kirkland, Wash. 98033

[21] Appl. No.: 845,839

[22] Filed: Mar. 28, 1986

[51] Int. Cl.[4] ..... B63B 15/00

[52] U.S. Cl. ..... 114/99

[58] Field of Search ..... 114/39, 39.2, 97–99, 114/102, 104, 106

[56] References Cited

U.S. PATENT DOCUMENTS

| | | | |
|---|---|---|---|
| 4,319,536 | 3/1982 | Schweitzer et al. | 114/99 |
| 4,436,047 | 3/1984 | Freyrie | 114/39.2 |
| 4,448,142 | 5/1984 | Pollard | 114/39.2 |
| 4,516,873 | 5/1985 | Humble et al. | 114/39.2 |
| 4,546,720 | 10/1985 | Dumortier | 114/98 |

FOREIGN PATENT DOCUMENTS

| | | | |
|---|---|---|---|
| 3301554 | 3/1984 | Fed. Rep. of Germany | 114/106 |

*Primary Examiner*—Jeffrey V. Nase
*Assistant Examiner*—Jesûs D. Sotelo
*Attorney, Agent, or Firm*—Robert W. Jenny

[57] ABSTRACT

The apparatus comprises two fixtures and a length of line. A primary fixture fits against the mast and interconnects the two spars of the wishbone boom. The second fixture turns relative to the first fixture. The line is attached at one end to the second fixture, threaded through both fixtures and around the mast in a way which attaches the first fixture to the mast and enables increasing the tension in the line to effect a firm attachment. The tension is increased by turning the second fixture, twisting portions of the line to increase the tension and then locking the second fixture to the first to maintain the tension. The twisting of the line provides the user with a mechanical advantage in tightening the line. The locking is done with a pin mounted in the second fixture engaging holes in the first.

4 Claims, 5 Drawing Figures

APPARATUS FOR ATTACHING SAIL-BOARD BOOM TO MAST

BACKGROUND OF THE INVENTION

1. Field of the Invention

The subject invention is in the field of sailboards, i.e. surfboards equipped for sailing with the operator standing essentially erect. The equipment comprises a sail attached to a mast and a boom. Specifically the invention is in the field of apparatus by which the boom is attached to the mast.

2. Prior Art

As the evolution of sailboards continues, the technology becomes more refined, aerodynamically and structurally. Aerodynamic and structural efficiency and cost effectiveness objectives rival those of aircraft. A key feature of the structural design is the means of attaching the boom to the mast. For convenience in transportation of the apparatus the boom is made readily attachable to and detachable from the mast. The point of attachment is adjustable along (i.e. up and down) the mast. The apparatus must be strong, light, flexible and as economically manufactured as practical. Part of this economy is achieved by avoiding requirements for close tolernces on the dimensions of parts of the apparatus. Avoiding close dimensional tolerances sets up special design problems, as will be evident from the prior art described and the following description of the invention.

The known prior art comprises the following U.S. patents, all related to the attachment of booms to masts of sailboards:

U.S. Pat. Nos. 4,319,536, 4,448,142, 4,334,488, 4,516,873, 4,436,047, 4,546,720.

U.S. Pat. No. 4,319,536 illustrates prior art in which the boom is lashed to the mast ("spar" in the patent) by a line, one end of which is tied onto the spar and the other end passes through holes in a fitting on the boom and the line is caught in a toothed V groove in the fitting. With this arrangement slippage of the boom along the mast during use has been frequently experienced and can only be remedied by completely undoing and redoing the attachment. It can be understood that this could be difficult if not impossible with the operator and sailboard in the water.

In the apparatus of U.S. Pat. No. 4,334,488 the boom is lashed to the mast by a "semi-elasticated circular strap." The term "circular" indicates that the strap is a loop. To fasten the boom to the mast the loop is attached to the mast and to a hook on the boom with the boom extending from the mast in a position 180° from its intended final position and then the boom is moved in an arc in the plane of the boom and mast. This movement, in combination with the geometry of the boom attachment fitting, stretches the strap to hold the boom firmly against the mast. In this apparatus also, positioning and repositioning the point of attachment of boom to the mast is cumbersome and awkward, particularly in the water and more particularly because it is necessary to detach the sail from the boom.

U.S. Pat. No. 4,436,047 is not directed to attachment of the boom to the mast but, instead, to means for keeping the sail taut in spite of deflection of the boom under loads. However, it appears that the tension in the sail and sail tensioning mechanism would put unusual loads into the attachment of the boom to the mast. The forces tensioning the sail tend also to move the boom forward off the mast.

In the apparatus of U.S. Pat. No. 4,448,142, the friction which is intended to keep the boom positioned along the mast is produced by the tight fit between a V shaped notch in the fitting by which the boom is attached to the mast. The tight fit is produced by moving the boom from a position essentially parallel to the mast (the storage position) to a position essentially at a right angle to the mast. However, the position of the boom on the mast at which all this happens is determined by the positioning of a fixture which clamps on the mast and supports the pivot about which the boom moves in the action described for providing the friction force. Therefore, to adjust the point of attachment of the boom to the mast requires moving the boom into a position essentially parallel to the mast and loosening the fastening of the clamp. This is clearly a cumbersome process since it also involves detaching the boom and sail. Further, the successful use of the clamp requires maintaining the dimensional tolerances of the apparatus to a level not usually met in the manufacture of such apparatus for cost reasons.

The apparatus of U.S. Pat. No. 4,516,873 is similar to that of patent of U.S. Pat. No. 4,448,142 in that the force that produces the friction which is intended to hold the boom in a position along the mast is produced by camming action between the boom and the mast as the boom is moved from a position essentially parallel to the mast to a position essentially at a right angle to the mast. In this case the camming is applied to a "clamshell" clamp which surrounds the mast. In this apparatus also, relocating the point of attachment of the boom to the mast requires extensive manipulation of the boom and detaching the sail from the boom. Also, for successful operation, the dimensional tolerances must be held closer than is considered economically acceptable for this type of apparatus.

The apparatus of U.S. Pat. No. 4,546,720 also uses friction between a part with a V shaped notch and the mast. The notch is forced against and thereby positioned on the mast by the tension in the sail when the sail is attached to the boom. Therefore, repositioning a dislocated boom connection will require detaching the sail from the boom. This will prove cumbersome and frustrating for one person to accomplish since the fixture for positioning the boom on the mast is at one end of the boom and the sail attachment point is at the other.

It is considered that it can be understood from the above brief descriptions of prior art that there is a need for means for attaching the booms of sailboards to the masts which provides simple, convenient attachment of the boom to the mast and simple, convenient adjustment and readjustment of the position at which the boom is attached. Further, the need calls for the apparatus to be easily managed by one person, even if the person and sailboard are in the water. Still further, it is required that the apparatus not require close dimensional tolerances for successful performance.

SUMMARY OF THE INVENTION

In response to the stated needs for means of attaching the sailboard boom to the mast, it is an objective of the invention that the attachment means be easily manageable by one person for installation of the boom at the desired point and adjustment and readjustment of the attachment point. Another objective is that the apparatus not require close dimensional tolerances for successful performance of its function.

The subject invention meets these objectives. It comprises a primary fitting into which the two spars of the wishbone boom are fitted and a secondary fitting. Each fitting has an axis. The axis of the primary fitting is essentially coincident with the longitudinal axis of symmetry of the boom. Similarly the axis of the second fitting is essentially coincident with the longitudinal axis of symmetry of the boom. The two fittings are adapted so that when the secondary fitting is positioned in its working position in contact with the primary fitting their axes are coincident and the secondary fitting can rotate about its axis relative to the primary fitting. The primary fitting has a hole through it, the axis of the hole being coincident with the axis of the fitting. It also has auxilliary holes extending from the central hole and positioned to be essentially tangential to the mast when the fixture is in contact with the mast. A length of line is attached at one of its ends to the secondary fitting. There is also means provided to lock the fittings together to prevent rotation of the secondary fitting relative to the primary fitting.

To attach the primary fitting, and thereby the boom assembly, to the mast, the line is passed from the secondary fitting through the holes in the primary fitting, wrapped around the mast and grooved projections on the primary fitting, passed back through the holes in the primary fitting to and through a matching hole in the secondary fitting. The line is then pulled tight by hand and secured to the secondary fitting. With the line installed as described there are two portions of it in the hole of the primary fitting and side-by-side, connecting the secondary fitting to the mast and thereby holding the boom in position on the mast. To increase the tension in the line, thereby holding the boom more securely in position on the mast, the secondary fitting is rotated on its axis, causing the two portions of line to twist together. This twisting causes the paths of the line portions between the mast and the secondary fitting to lengthen. However, the line cannot stretch enough to follow the lengthened path and therefore the tension in the lines is increased by the rotation of the secondary fitting. When sufficient tension has been provided, it is maintained by locking the two fittings together to prevent unwinding, detensioning rotation of the secondary fitting relative to the primary fitting.

To reposition the attachment point of the boom to the mast the secondary fitting is unlocked from the primary and turned to decrease the tension in the line. The attachment point can then be changed by sliding the boom and the line portion encircling the mast along the mast. The boom is secured in the new position by turning the secondary fitting to retension the line and then by locking the fittings together again. The boom is detached from the mast by detensioning the line, detaching the detachable end of the line from the secondary fitting and threading the line back through the primary fitting and back around the mast.

It is considered evident from this summary that the invention meets its objectives. The boom can be attached to and detached from the mast and repositioned on the mast without manipulation of the boom or detachment and attachment of the sail to the boom. All attachment, detachment and repositioning can be readily and easily accomplished by one person even in the water. Also, because the attachment is with a line, no close dimensional tolerances are required.

The details of the apparatus and its use can be understood in more detail with reference to the drawings and the detailed description of the invention which follows.

DETAILED DESCRIPTION OF THE INVENTION

Figure 1:
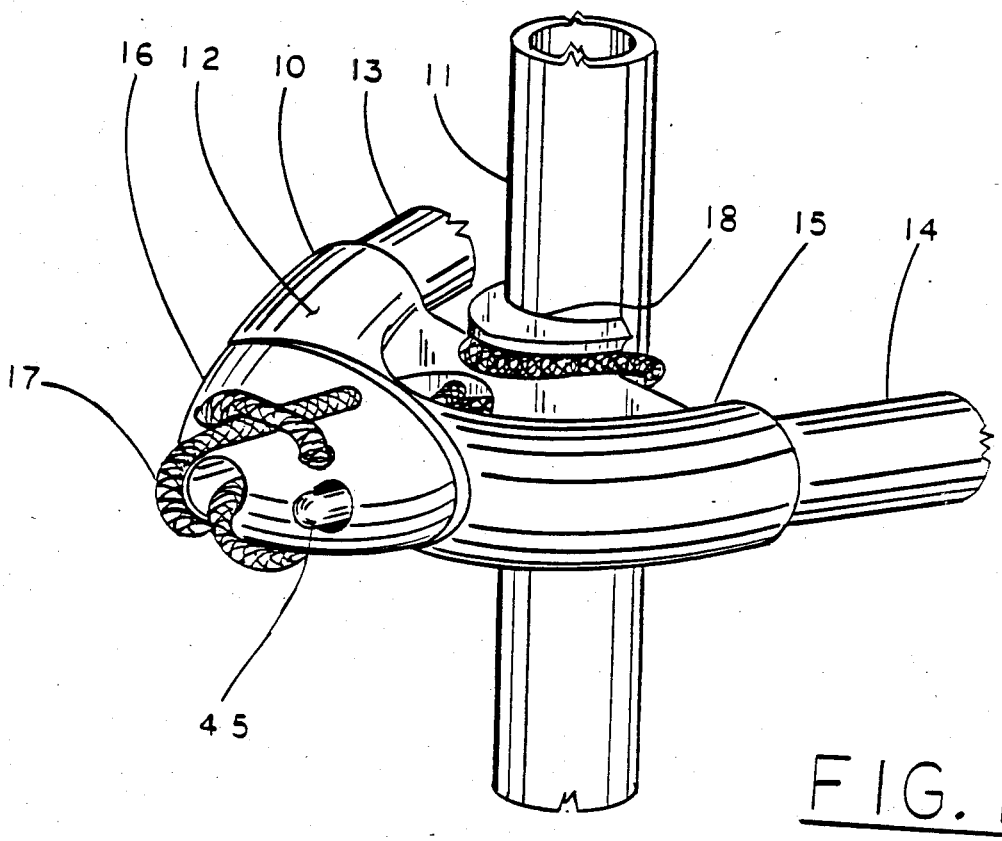
FIG. 1 is a perspective view of a boom attached to a mast by the subject apparatus.

Referring to FIG. 1, the mast end of boom assembly 10 is shown attached to mast 11 by boom-to-mast attachment apparatus 12. The part of the boom assembly shown in the drawing comprises spars 13 and 14, and first fixture 15 and second fixture 16 of apparatus 12. Line 17 retains the boom against the mast with the mast seated in saddle 18 on fixture 15.

Figure 2:
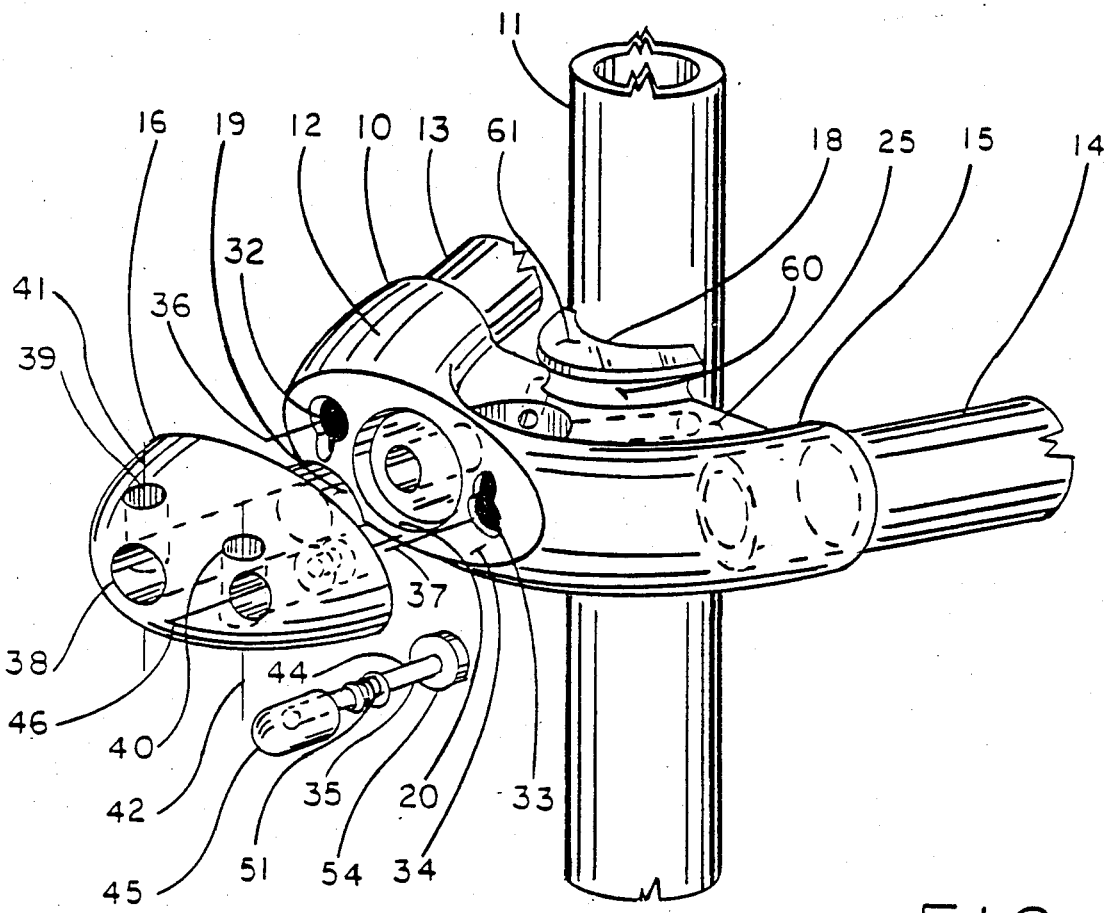
FIG. 2 is an exploded view of the apparatus, showing more detail than FIG. 1.
Figure 2A:
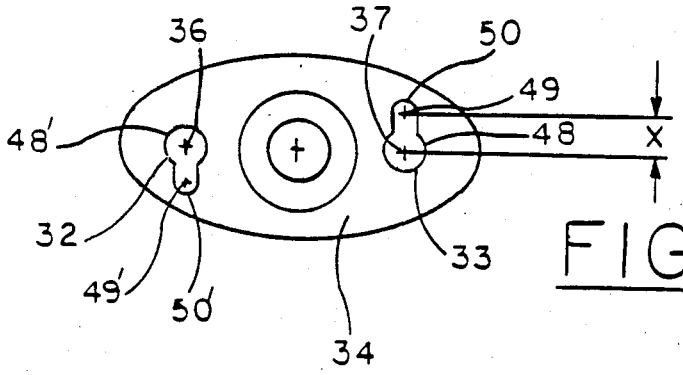
FIG. 2A illustrates details of holes and hole locations of apparatus shown in FIG. 2.
Figure 3:
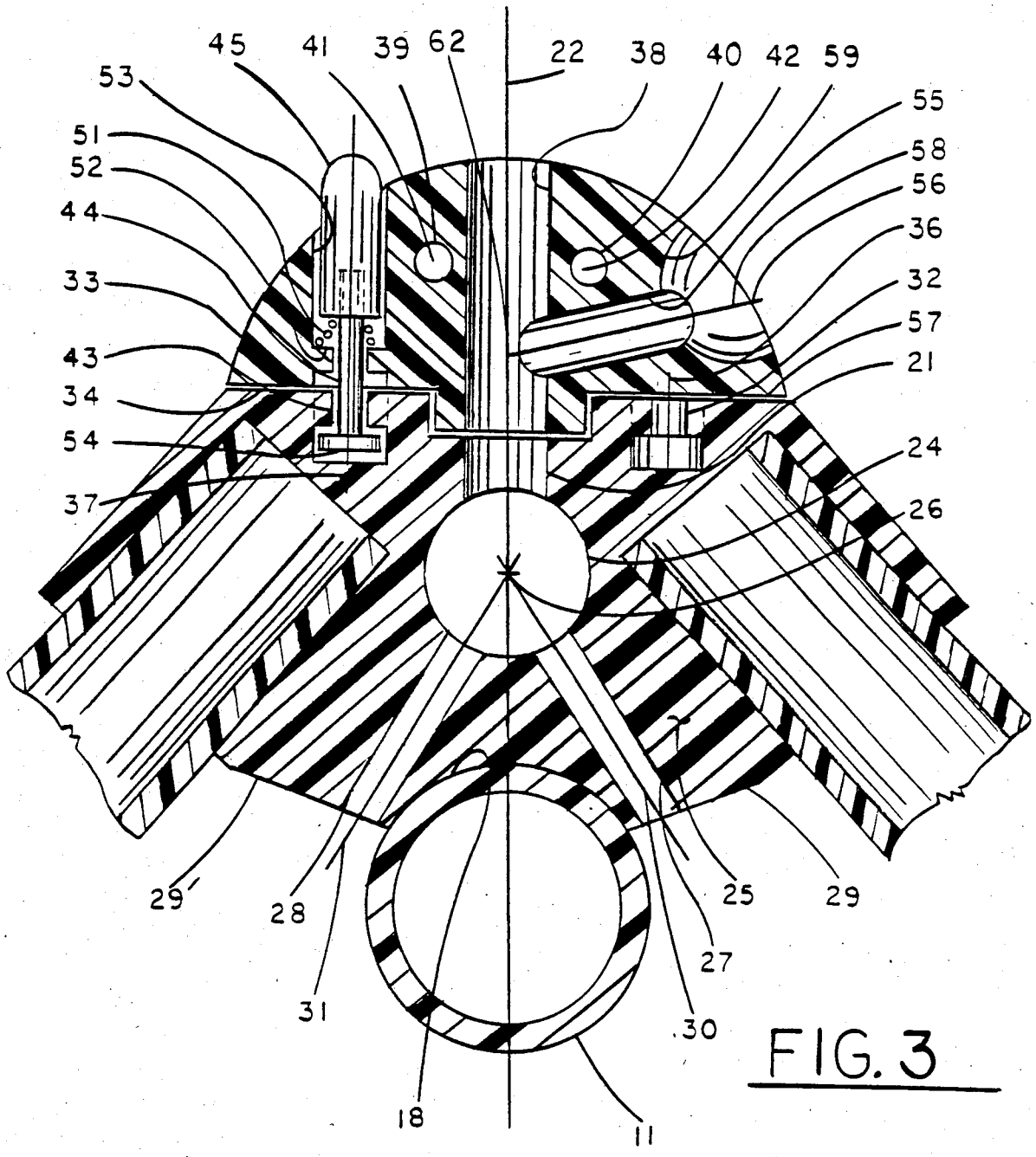
FIG. 3 is a sectional view taken in FIG. 1 in a plane perpendicular to the longitudinal axis of the mast and intersecting the longitudinal axis of symmetry of the boom.

Detailed description of fixtures 15 and 16 and associated detailed parts requires interspersed references to FIGS. 2 and 3. When the apparatus is fully assembled as shown in FIG. 1, pilot 19 on fixture 16 fits into counterbore 20 in fixture 15 (see FIG. 2), so that fixture 16 can be rotated with respect to fixture 15. There are four cylindrical holes in fixture 16 through which line 17 passes (see FIGS. 3 & 3A). Hole 21 is located with its axis coincident with longitudinal axis of symmetry 22 of the boom. Hole 24 runs through web 25 and its axis 26 intersects axis 22 perpendicularly and is essentially parallel to the mast 11. Holes 27 and 28 run from hole 24 to faces 29 and 29'. Their axes 30 and 31 respectively intersect axis 26 and lie in the plane of FIG. 3. Axes 30 and 31 are angled to axis 22 so that the surfaces of holes 27 and 28 where they are closest to mast 11, are tangential to it. Holes 32 and 33 in face 34 of fixture 15 (see FIG. 2A) are keyhole shaped and receive lock pin 35 in the manner and for purposes described later. There are hollow spaces behind the keyholes. The axes 36 and 37 of the cylindrical portions of holes 32 and 33 are parallel to axis 22 and lie in the plane of FIG. 3.

There are five cylindrical holes in fixture 16. Hole 38 runs through fixture 16 with its axis coincident with axis 22. Holes 39 and 40 have axes 41 and 42 respectively in a plane normal to axis 22 and equally spaced from axis 22. Hole 43, (FIG. 3) accepts shaft 44 of lockpin 35 and is counterbored to accept knob 45 attached to shaft 44. Axis 46 of hole 43 (FIG. 2) is parallel to axis 22 and is out of the plane of FIG. 3 by distance X (FIG. 2A), the distances between the axes 36 and 37 of the cylindrical portions 48 and 48' and centers 49 and 49' of the radial portions 50 and 50' of holes 32 and 33. However, hole 43 is shown in the plane of FIG. 3 for clarity. Conical spring 51 fits between knob 45 and bottom 52 of counterbore 53 and serves to pull head 54 of lock pin 35 out of holes 32 and 33, as explained later. Hole 55, not visible in FIGS. 1 and 2, has its axis 56 in the plane of FIG. 3 and runs from the surface of fixture 16 to hole 38. Axis 56 is at a slight angle to face 57 of fixture 16 with end 58 of axis 56 slightly further from face 57 than end 62 of axis 56. Hole 55 opens into pocket 59 in the surface of fixture 16.

Figure 3A:
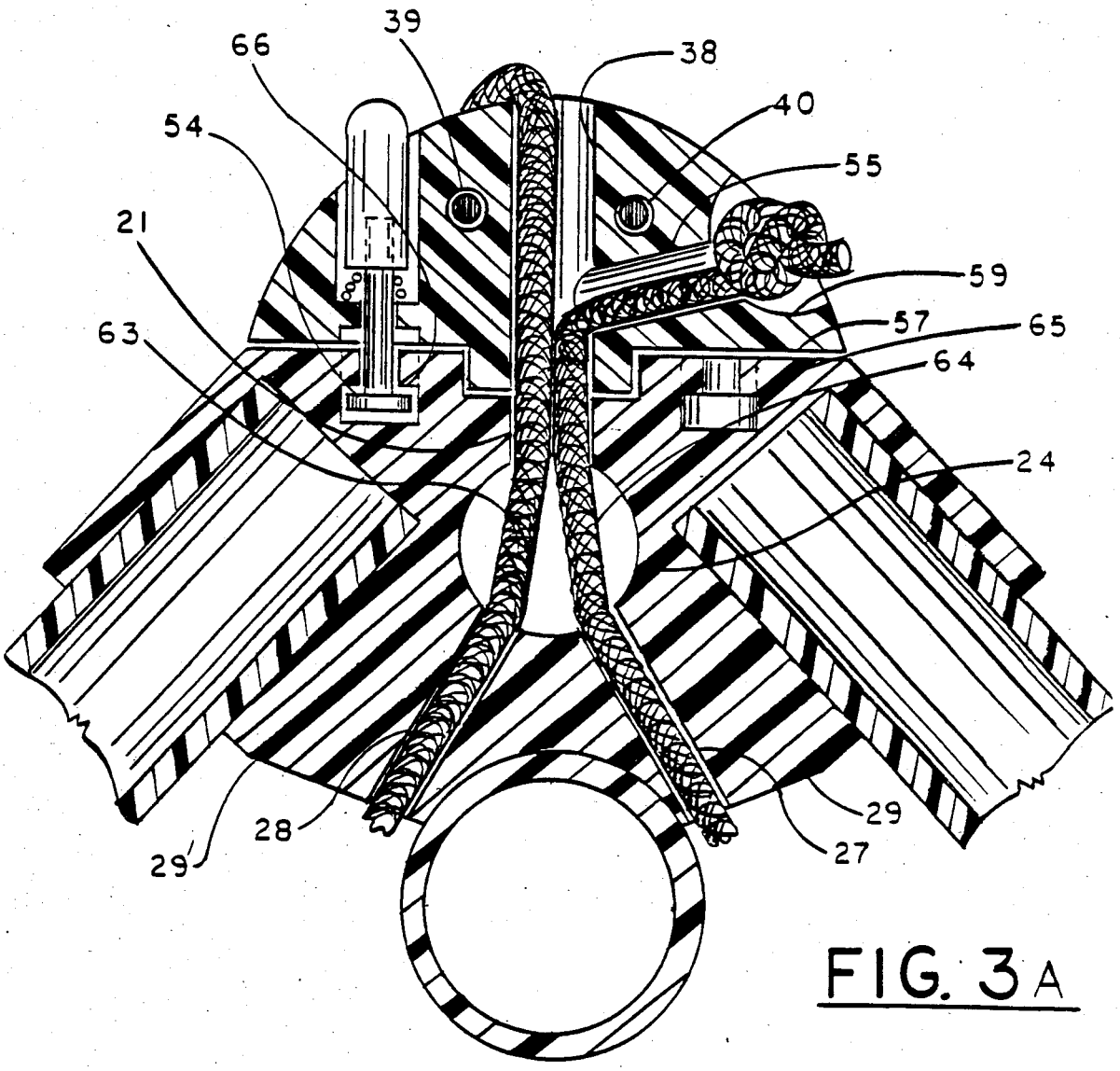
FIG. 3A illustrates in part the routing of a line used in the apparatus.

Referring to FIGS. 1 and 3A, line 17 is routed as follows to serve its function of attaching the boom to the mast. It is threaded through hole 55 and a knot at its end comes to rest in pocket 59. Line 17 passes from hole 55 into hole 38, then through hole 21, across hole 24 and into hole 27. The line is then passed around the mast, and into groove 60 of grooved protuberance 61 on fixture 15. The line is then passed around the mast and into a second groove, not shown but similar to groove 60 on a grooved protuberance similar to protuberance 61 but on the opposite side of fixture 15 from protuberance 61. The line is then passed through hole 28, across hole 24, through holes 21 and 38 and then through hole 39 across the surface of fixture 16 to hole 40, and then through hole 40. The end is then passed between the portion of line between holes 39 and 40 and the surface of fixture 16, thus retaining the end.

It can now be seen that portions 63 and 64 (FIG. 3A) of line 17 are close and in close linear proximity from holes 27 and 28 to hole 55. The line is installed as described as snugly as practical by hand. Then, when fixture 16 is rotated around axis 22 line portions 63 and 64 twist together. This twisting requires that the lengths of portions 63 and 64 increase and, since the line is only slightly stretchable, the requirement for extra length is met by drawing line toward portions 63 and 64 from holes 38, 56, 27 ad 28, putting all of the line under tension and firmly securing the boom to the mast. It will be understood by those skilled in the art that twisting the line portions together as described provides the user a mechanical advantage which enables producing considerably more tension in the line than could be provided by applying tension directly to the line(s) by hand. When sufficient tension has been generated, fixture 16 is prevented from rotating to relieve the tension by locking it to fixture 15. This is done by aligning pin 35 with the circular portion of either hole 32 or 33, pushing on knob 45 to move pin 35 against the force of spring 51 so that head 54 of pin 35 enters either hole 32 or 33. Fixture 16 is then allowed to rotate slightly in the direction to relieve tension, moving shaft 44 of lock pin 35 into the narrower portion of the engaged keyhole with head 56 trapped in the hole behind ledge 65 or 66 (FIG. 3A).

To reposition the boom along the mast, fixture 16 is rotated in the direction to increase tension until head 54 is aligned with the circular portion of the keyhole in which it was trapped. Spring 51 then moves it out of the hole and fixture 16 is free to be rotated in the tension relieving direction sufficiently to allow the boom to be moved along the mast. The apparatus is then retensioned.

To unfasten the boom from the mast, the line tension is relieved as explained for repositioning and then the line is unthreaded through the path described to free the boom from the mast.

From this more detailed description it can be understood that the invention meets its objectives. Since all attachment, adjustment and detachment functions are done at the juncture of the mast and boom, and no extensive manipulation of the boom is required, all the functions can be readily managed by one person, even in the water. Further, it is clear that no close tolerance sizing of the parts of the apparatus is required.

It will also be clear to those skilled in the art that, while a preferred embodiment of the invention has been described, other embodiments and variations of the one described are possible within the scope of the invention which is limited only by the attached claims.

What is claimed is:

1. Apparatus for attaching a sailboard boom to a sailboard mast comprising:

a first fixture integrated into said boom, a length of line, said first fixture having means for adapting it for attachment to said mast by said length of line with tension in said line, said apparatus further comprising:

means for adjusting said tension in said line comprising a second fixture moveable relative to said first fixture, said tension being adjustable by motion of said second fixture relative to said first fixture.

2. The apparatus of claim 1 further comprising:

means for selectively locking said second fixture to said first fixture to selectively prevent said motion.

3. Apparatus for attaching a sailboard boom to a sailboard mast, said boom comprising two spars, said apparatus comprising:

a first fixture, a second fixture, a line having a first end and a second end, and means for selectively locking said second fixture to said first fixture, said first fixture having means for attachment of said two spars to said first fixture, holes for passages of said line, at least one grooved protuberance and a saddle for engagement of said first fixture with said mast, said second fixture having means for attaching said first and second ends of said line to said second fixture and holes for passages of said line, said first and second fixtures, in combination, having means for enabling rotation of said second fixture relative to said first fixture and accommodations for installation of said means for selectively locking said second fixture to said first fixture to prevent said rotation, said holes for passages of said lines being oriented so that first and second portions of said line are in close linear proximity and extending between said first and second fixtures, said boom being attached to said mast by attaching said two spars to said fixture and attaching said first fixture to said mast by placing said saddle against said mast, installing said means for selectively locking in said second fixture, placing said second fixture in close cooperative proximity to said first fixture, placing said second fixture in close cooperative proximity to said first fixture, passing said line through said holes for passages of said line in said first fixtures, around said mast and said at least one grooved protuberance, back through said holes for passages of said line in said first and second fixtures, pulling on said line to put it in tension, attaching said first and second ends of said lines to said second fixture, rotating said second fixture, causing said first and second portions of said line in close proximity to twist together to increase said tension and operating said means for selectively locking to lock said second fixture to said first fixture.

4. Apparatus for attaching the boom of a sailboard to the mast of a sailboard, said boom having two spars, said two spars each having an end for engagement in said apparatus, said apparatus comprising:

a first fixture, a second fixture, a line having a first and a second end and a knot near said first end, said first and second fixtures being adapted for rotation of said second fixture relative to said first fixture and incorporating means for selectively locking said second fixture to said first fixture to selectively prevent said rotation, said first fixture having means for engaging said ends of said two spars, holes for passages of said line, first and second grooved protuberances for engagement of said line and a saddle for engagement of said first fixture against said mast, said second fixture having holes for passages of said line, means for retaining said knot and means for attaching said second end to said second fixture, said holes in said first and second fixtures being oriented so that two portions of said line, when it is passed through said holes, are in close linear proximity to each other, whereby, to attach said boom to said mast, said ends of said two spars are engaged in said means for engaging said ends, said saddle is placed against said mast, said second end of said line is passed through said first and second fixtures, around said mast, around said first grooved protuberance, around said mast again and around said second grooved protuberance, back through said first and second fixtures, at which point tension is applied to said line to cause said knot to be engaged by said means for retaining said first end in said second fixture, said first and second fixtures and said mast are drawn into close proximity with each other and said second end is attached to said second fixture and said second fixture is rotated relative to said first fixture causing said two portions of said line in close linear proximity to twist together to increase the tension in said line and said second feature is locked by said locking means to said first fixture to retain said tension in said line.

* * * * *